US008973474B2

(12) United States Patent
Lai

(10) Patent No.: US 8,973,474 B2
(45) Date of Patent: Mar. 10, 2015

(54) SCREWDRIVER BIT STRUCTURE HAVING AUXILIARY POSITIONING FUNCTION

(75) Inventor: Ying-Tsung Lai, Taichung (TW)

(73) Assignee: Rote Mate Industry Co., Ltd., Taichung (TW)

( * ) Notice: Subject to any disclaimer, the term of this patent is extended or adjusted under 35 U.S.C. 154(b) by 410 days.

(21) Appl. No.: 12/461,691

(22) Filed: Aug. 20, 2009

(65) Prior Publication Data

US 2010/0307298 A1 Dec. 9, 2010

(30) Foreign Application Priority Data

Jun. 5, 2009 (TW) ..... 98209977 U

(51) Int. Cl.

| | |
|---|---|
| ***B25B 23/08*** | (2006.01) |
| ***B25B 23/10*** | (2006.01) |
| ***B25B 23/00*** | (2006.01) |
| ***B25B 15/00*** | (2006.01) |

(52) U.S. Cl.

CPC ..... *B25B 23/00* (2013.01); *B25B 23/005* (2013.01); *B25B 15/00* (2013.01); *B25B 15/002* (2013.01)

USPC ..... 81/451; 81/184

(58) Field of Classification Search

CPC ..... B25B 15/00; B25B 15/02; B25B 23/005

USPC ..... 81/436, 180.1, 184, 185.2, 451, 492, 81/28, 30, 37, 462, 177.1, 489; 408/115 B, 408/72 B

See application file for complete search history.

(56) References Cited

U.S. PATENT DOCUMENTS

| | | | | | |
|---|---|---|---|---|---|
| 2,609,851 | A * | 9/1952 | Hadfield | 81/489 |
| 3,288,185 | A * | 11/1966 | Clark | 81/451 |
| 3,517,714 | A * | 6/1970 | Desbarats | 81/451 |
| 3,739,825 | A * | 6/1973 | Knox | 81/451 |
| 5,003,850 | A * | 4/1991 | Harkins | 81/436 |
| 5,012,708 | A * | 5/1991 | Martindell | 81/429 |
| 5,101,698 | A * | 4/1992 | Paradiso | 81/451 |
| 5,182,973 | A * | 2/1993 | Martindell | 81/429 |
| 5,591,207 | A * | 1/1997 | Coleman | 606/232 |
| 6,138,538 | A * | 10/2000 | Neijndorff | 81/451 |
| 6,761,095 | B2 * | 7/2004 | Beauchamp | 81/490 |
| 7,574,946 | B1 * | 8/2009 | Chang | 81/451 |
| 7,627,968 | B2 * | 12/2009 | Lin | 40/306 |
| 7,836,801 | B2 * | 11/2010 | Huang | 81/177.1 |
| 2005/0098002 | A1 * | 5/2005 | Holland-Letz | 81/451 |
| 2010/0011918 | A1 * | 1/2010 | Ray | 81/451 |
| 2011/0197721 | A1 * | 8/2011 | DeBaker | 81/436 |

* cited by examiner

*Primary Examiner* — Bryan R Muller

(74) *Attorney, Agent, or Firm* — Raymond Y. Chan; David and Raymond Patent Firm

(57) ABSTRACT

A screwdriver bit structure having auxiliary positioning function includes a screwdriver bit of which one end is a circular cylinder and having a driving portion that is any one of a slotted type, a cross type and a polygon type. Another end of the circular cylinder is a fitting portion that is buckled to the screwdriver bar. The features of the invention are that the circular cylinder has a concave ring groove near the front of the driving portion. An auxiliary sheath is a long tube body that has a tube hole. The internal diameter of the tube hole is slightly larger than the periphery of the circular cylinder. A protruding ring is disposed to an internal wall of the tube hole. Accordingly, the tube hole of the auxiliary sheath can cover the periphery of the circular cylinder to allow the screwdriver bit to achieve the absolute positioning.

9 Claims, 10 Drawing Sheets

SCREWDRIVER BIT STRUCTURE HAVING AUXILIARY POSITIONING FUNCTION

FIELD OF THE INVENTION

The present invention relates to a screwdriver bit structure, and more particularly to a screwdriver bit structure that has auxiliary positioning function.

BACKGROUND OF THE INVENTION

According to a conventional technique shown in U.S. design Pat. D410,372 entitled "screwdriver bit", its appearance showed that the upper section portion is a hexagon shaft where the lower section portion has a circular shaft. A protruding ring section with larger exterior diameter is formed to the upper position of the circular shaft where a cross driving portion is formed to the lower position of the circular shaft. Since the foregoing conventional technique belonged to the design patent, it may not understand that how can the protruding ring section disposed to the upper position of the circular shaft work; and further it may not understand that whether the protruding ring section is integrated with or connected to the circular shaft.

Therefore, the screwdriver bit structure having the appearance that is similar to the protruding ring section for sale on market can be approximately divided into two categories.

First, the protruding ring section is integrated with the screwdriver bit through the forging process. Afterward, the external surface of the protruding ring section is coated with colors for recognition purpose.

Second, the protruding ring section with colors is directly combined with a predetermined place of the screwdriver bit through plastic injection. The protruding ring section can closely cover the shaft of the screwdriver bit through the combination manner so as to firmly achieve the integration. Consequently, the protruding ring section cannot be rotated individually. At the most, the efficiency can merely provide recognition purpose.

Upon the foregoing technique, no matter which technique is used to complete U.S. design Pat. D410,372, the protruding ring section is integrated with the screwdriver bit through consolidation to achieve the color recognition function and the protruding ring section may not perform independent rotation by itself as well.

Accordingly, to overcome the foregoing shortcomings, the inventor(s) of the present invention based on years of experience in the related field to conduct extensive researches and experiments for the screwdriver structure with the auxiliary sheath, and finally invented a screwdriver bit structure having auxiliary positioning function.

SUMMARY OF THE INVENTION

A primary objective of the present invention is to provide a screwdriver bit structure having auxiliary positioning function that is held by hands and used for positioning the screwdriver bit to prevent the screwdriver bit from offsetting and coming off while rotating the screwdriver bit.

To achieve the foregoing objective, the screwdriver bit structure having auxiliary positioning function comprises a screwdriver bit and an auxiliary sheath. One end of the screwdriver bit is a circular cylinder. The front of the circular cylinder has a driving portion where another end has a fitting portion with a polygon. The circular cylinder has a concave ring groove near the front of the driving portion. The auxiliary sheath is sheathed to a periphery of the driving portion of the circular cylinder, and is a long tube body that has a tube hole passing through the tube body.

A protruding ring is disposed in an internal wall of the tube hole, and can be fastened to the concave ring groove of the circular cylinder. Two sides of the protruding ring within the tube hole form a long inserting portion and a short inserting portion. The long inserting portion covers a portion of the driving portion where the short inserting portion covers a portion of the circular cylinder. Accordingly, the screwdriver bit showing fastening state can independently move with the auxiliary sheath so that the screwdriver bit can be positioned without generating any shake while holding the auxiliary sheath. When the screwdriver bit is rotably locked, the screwdriver bit can effectively and stably rotate to prevent the screwdriver bit from offsetting and coming off.

DETAILED DESCRIPTION OF THE PREFERRED EMBODIMENTS

Figure 1:
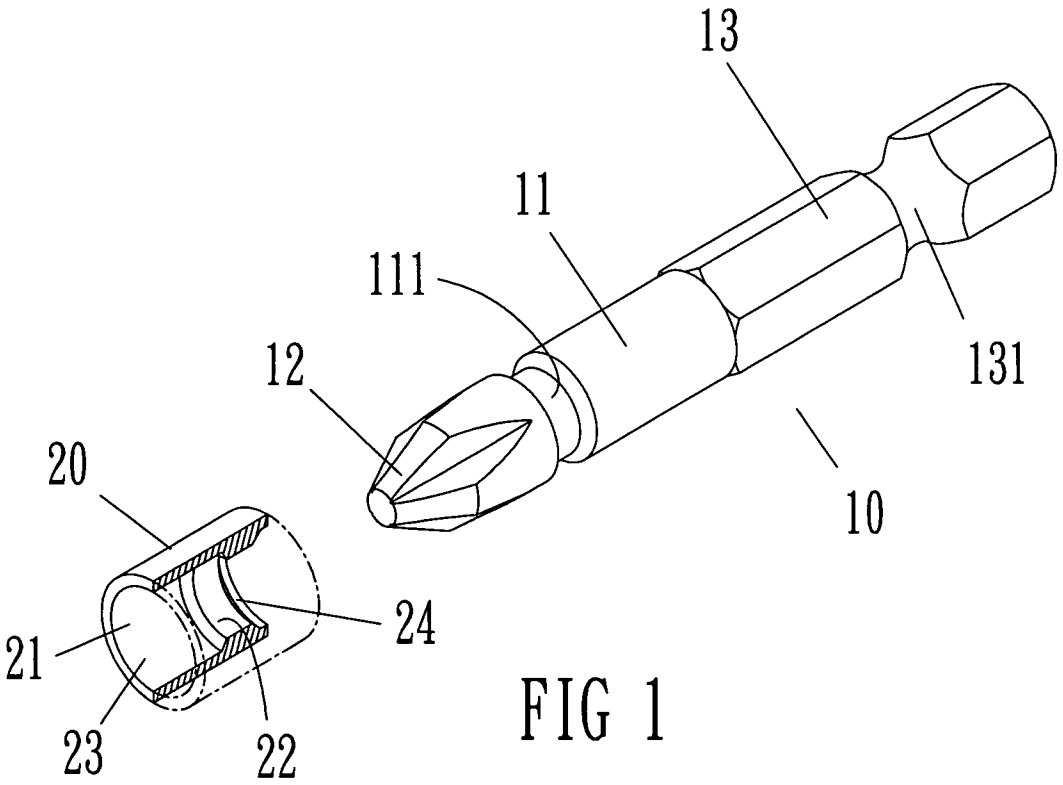
FIG. 1 is a decomposition drawing illustrating a structure according to a preferred embodiment of the present invention.
Figure 2:
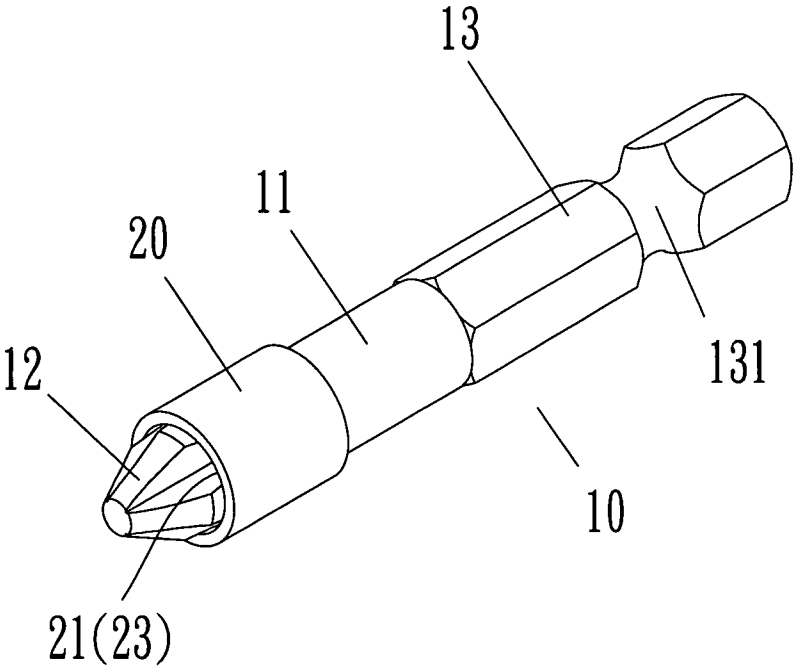
FIG. 2 is an assembly drawing illustrating a structure according to a preferred embodiment of the present invention.
Figure 3:
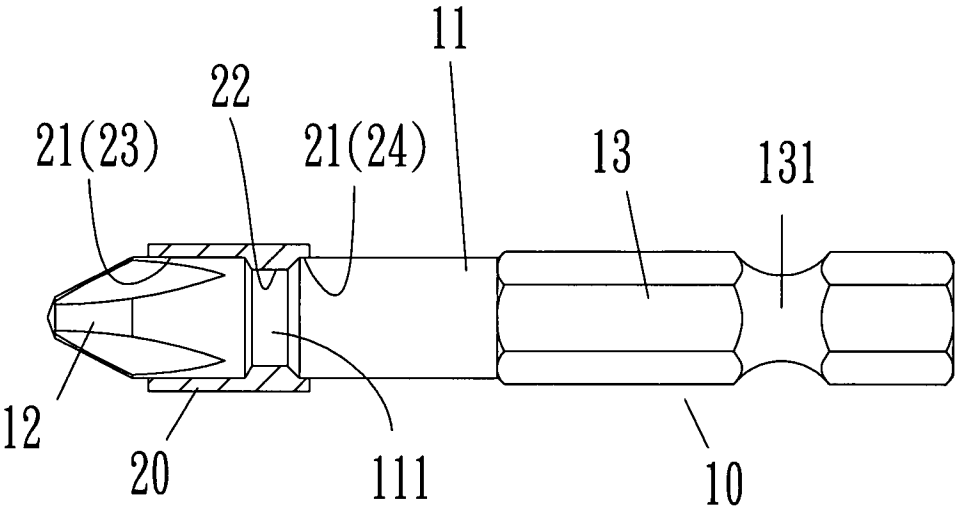
FIG. 3 is a cross-sectional drawing of front view assembly illustrating the structure according to a preferred embodiment of the present invention.
Figure 4:
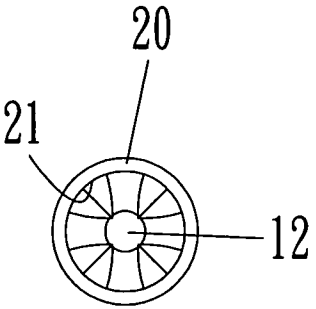
FIG. 4 is a side-view drawing illustrating the structure according to a preferred embodiment of the present invention.
Figure 5:
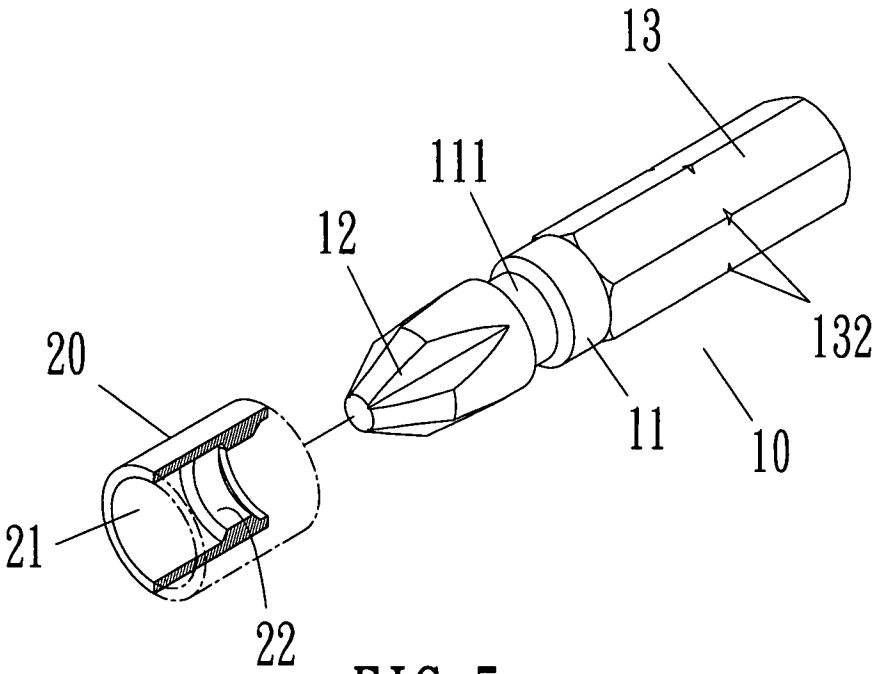
FIG. 5 is a decomposition drawing illustrating the structure according to a preferred embodiment II of the present invention.
Figure 6:
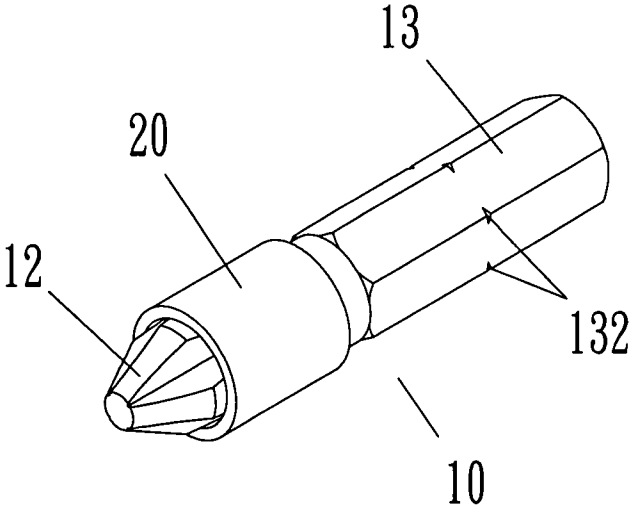
FIG. 6 is an assembly drawing illustrating the structure according to a preferred embodiment II of the present invention.
Figure 7:
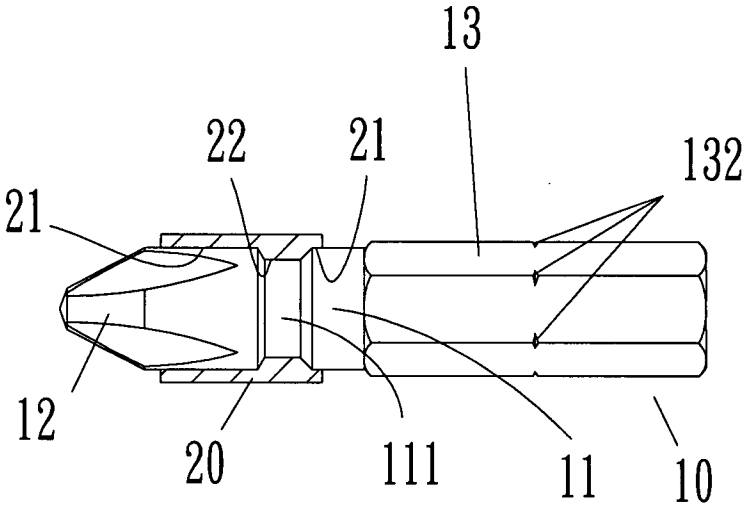
FIG. 7 is a cross-sectional drawing of front view assembly illustrating the structure according to a preferred embodiment II of the present invention.
Figure 8:
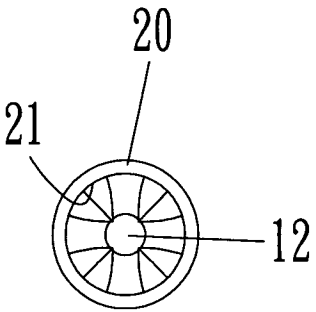
FIG. 8 is a side-view drawing illustrating the structure according to a preferred embodiment II of the present invention.
Figure 9:
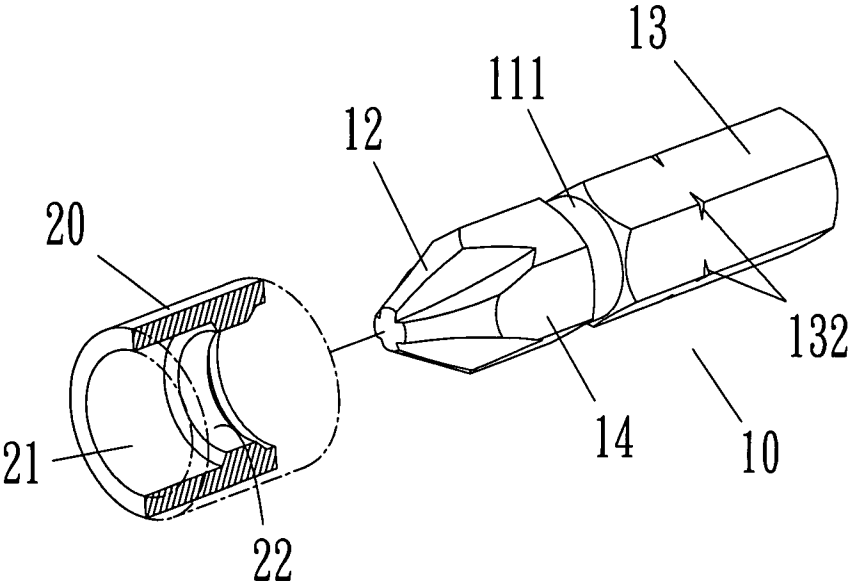
FIG. 9 is a decomposition drawing illustrating the structure according to a preferred embodiment III of the present invention.
Figure 10:
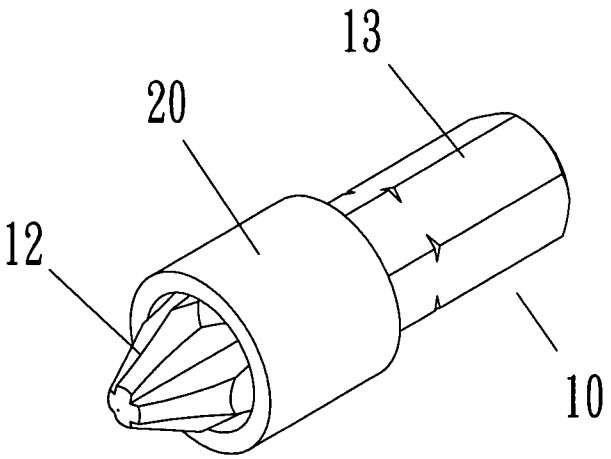
FIG. 10 is an assembly drawing illustrating the structure according to a preferred embodiment III of the present invention.
Figure 11:
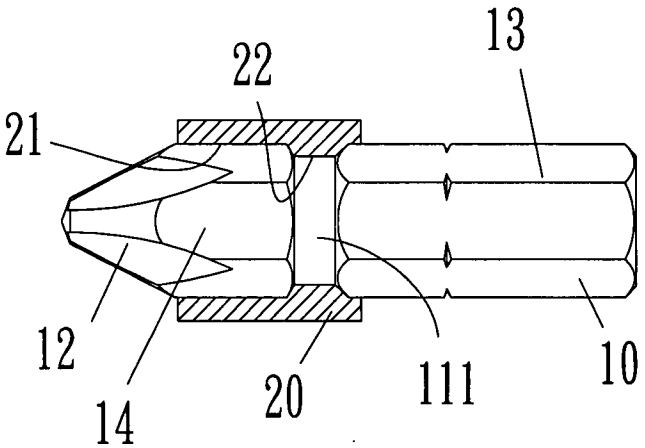
FIG. 11 is a cross-sectional drawing of front view assembly illustrating the structure according to a preferred embodiment III of the present invention.
Figure 12:
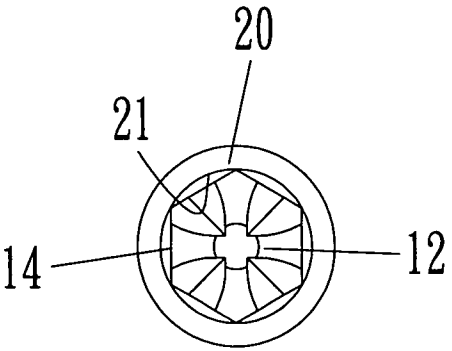
FIG. 12 is a side-view drawing illustrating the structure according to a preferred embodiment III of the present invention.

Other features and advantages of the present invention will become apparent from the following description of the invention which refers to the accompanying drawings.

First, please refer to FIG. 1 to FIG. 4, a screwdriver bit structure having auxiliary positioning function is shown according to a preferred embodiment I of the present invention, and composed of a screwdriver bit 10 and an auxiliary sheath 20. An end of the screwdriver bit 10 is a circular cylinder 11. A front of the circular cylinder 11 has a driving portion 12. Another end of the circular cylinder 11 is a fitting portion 13. The front of the driving portion 12 is any one of a slotted type, a cross type, and a polygon type. The circular cylinder 11 has a concave ring groove 111 near the front of the driving portion 12. The fitting portion 13 of the circular cylinder 11 is a polygon column. An arc groove 131 is further disposed to a middle section of the polygon column so as to connect a screwdriver bar (not shown in the figure).

The auxiliary sheath 20 is a long tube body through plastic injection, and has a tube hole 21 passing through the tube body along an axial direction. The internal diameter of the tube hole 21 is slightly greater than the external diameter of the circular cylinder 11. A protruding ring 22 is disposed near a side edge of the internal wall of the tube hole 21. Accordingly, two sides of the protruding ring 22 of the tube hole 21 form a long inserting portion 23 and a short inserting portion 24.

With the foregoing components, when the tube hole 21 of the auxiliary sheath 20 is fitted with the circular cylinder 11 of the screwdriver bit 10 and the protruding ring 22 of the auxiliary sheath 20 is buckled to the concave ring groove 131 for positioning, the long inserting portion 23 of the auxiliary sheath 20 covers a portion of the driving portion 12 where the short inserting portion 24 covers a periphery of the circular cylinder 11 so that the auxiliary sheath 20 assembled to the screwdriver bit 10 can achieve the absolute solidification to prevent coming off. When a hand holds the auxiliary sheath 20 under stop state, the screwdriver bit 10 can be freely and randomly rotated.

Therefore, while rotating the screwdriver bit 10, the screwdriver bit 10 can be accurately positioned by holding the auxiliary sheath 20 to prevent the screwdriver bit 10 from offsetting or prevent the screwdriver bit 10 from coming off during the rotation.

Moreover, referring to FIG. 5 to FIG. 8, a screwdriver bit structure having auxiliary positioning function is shown according to a preferred embodiment II of the present invention. The main technical features shown in the embodiment is completely the same as the foregoing embodiment. The structure is composed of a screwdriver bit 10 and an auxiliary sheath 20. The circular cylinder 11 of the screwdriver bit 10 has a concave ring groove 111 near the end portion of the driving portion 12. The auxiliary sheath 20 has a protruding ring 22 that can be fitted to the concave ring groove 111. Its structural difference is that the fitting portion 13 as a polygon cylinder of the screwdriver bit 10 has a plurality of gaps 132 at adjacent intersections to buckle the screwdriver bars with different types.

Referring to FIG. 9 to FIG. 12, a screwdriver bit structure having auxiliary positioning function is shown according to a preferred embodiment III of the present invention. The technical features shown in the embodiment is extended from the foregoing embodiments. The structure is composed of a screwdriver bit 10 and an auxiliary sheath 20. A driving portion 12 is disposed to an end of the screwdriver bit 10, and is at the front of the polygon cylinder 14. A concave ring groove 111 is disposed to a front of the polygon cylinder 14 near the driving portion 12. Further, the auxiliary sheath 20 has a protruding ring 22 that can be fitted to the concave ring groove 111 for positioning.

The length of the screwdriver bit 10 shown in the embodiment III is a shorter specification, and has a plurality of gaps 132 at predetermined positions of the fitting portion 13 as the polygon cylinder to buckle the screwdriver bars with different types.

Figure 14:
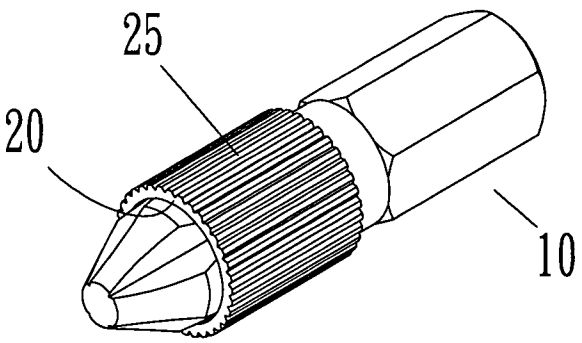
FIG. 14 is a schematic drawing illustrating an auxiliary sheath according to a further embodiment of the present invention.
Figure 13:
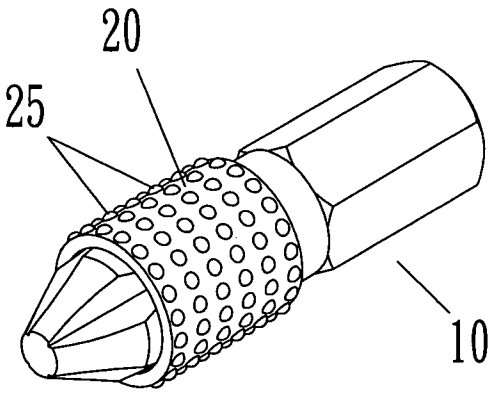
FIG. 13 is a schematic drawing illustrating an auxiliary sheath according to another embodiment of the present invention.

Referring to FIGS. 13 and 14, an external surface of the auxiliary sheath 20 of the present invention can have the non-slip portions 25. The non-slip portions 25 are embossments that are uniformly distributed to the external periphery of the auxiliary sheath 20 as shown in FIG. 13 so as to increase the surface roughness. Of course, a plurality of circular cavities (not shown in the figure) can be utilized to replace the foregoing embossments to achieve the goal of increasing the surface roughness of the auxiliary sheath 20 as well. In addition, as shown in FIG. 14, the non-slip portions 25 can be multiple long cavities arranged in parallel. The disposition direction of the long cavities is parallel the center axis of the auxiliary sheath 20.

Although the features and advantages of the embodiments according to the preferred invention are disclosed, it is not limited to the embodiments described above, but encompasses any and all modifications and changes within the spirit and scope of the following claims.

What is claimed is:

1. A screwdriver bit structure having auxiliary positioning function comprising:

a screwdriver bit having a front driving portion, a rear fitting portion, a circular cylinder extended between said driving portion and said fitting portion, and a concave ring groove formed between said driving portion and said circular cylinder, wherein said fitting portion of said circular cylinder is a polygon shaft body; and an auxiliary sheath which is a tube body being securely fastened at said screwdriver bit in a rotatably movable manner to prevent said auxiliary sheath from offsetting and coming off said screwdriver bit while rotating said screwdriver bit, wherein said auxiliary sheath comprises an elongated tube body which has a tube hole and a protruding ring integrally extended from an internal wall of said tube hole to define a long inserting portion and a short inserting portion, wherein a length of said long inserting portion is larger than a length of said short inserting portion, wherein an internal diameter of said tube hole is slightly greater than an external diameter of said circular cylinder to fit said circular cylinder with said tube hole, such that said internal diameter of said tube hole at said long inserting portion equals to said internal diameter of said tube hole at said short inserting portion which is slightly greater than said external diameter of said circular cylinder, wherein an internal diameter of said long inserting portion is larger than an internal diameter of said protruding ring, wherein an internal diameter of said short inserting portion is larger than the internal diameter of said protruding ring, wherein said protruding ring fits in said concave ring groove such that a length of said protruding ring matches with a length of said concave ring groove, wherein said auxiliary sheath is fitted to said concave ring groove in such a manner that said protruding ring of said auxiliary sheath is rotatably coupled within said concave ring groove to prevent said auxiliary sheath being detached from said front driving portion of said screwdriver bit, said long inserting portion covers and rotatably extends at a periphery of said front driving portion to expose a driving head of said driving portion out of said long inserting portion, and said short inserting portion covers a periphery of said circular cylinder, so as to allow said screwdriver bit freely rotating in said tube hole of said auxiliary sheath and prevent forward and backward sliding movements along a length of said auxiliary sheath.

2. The screwdriver bit structure having auxiliary positioning function, as recited in claim 1, wherein said auxiliary sheath is made of plastic and is mold-injected to fit with said screwdriver bit.

3. The screwdriver bit structure having auxiliary positioning function, as recited in claim 2, wherein said driving head of said driving portion is any one of a slotted type, a cross type, and a polygon type.

4. The screwdriver bit structure having auxiliary positioning function, as recited in claim 1, wherein an external periphery of said auxiliary sheath has a non-slip portion.

5. The screwdriver bit structure having auxiliary positioning function, as recited in claim 4, wherein said non-slip portion is multiple embossments that are uniformly distributed to said external periphery of said auxiliary sheath.

6. The screwdriver bit structure having auxiliary positioning function, as recited in claim 4, wherein said non-slip portion is multiple long cavities arranged in parallel.

7. The screwdriver bit structure having auxiliary positioning function, as recited in claim 1, wherein said driving portion of said circular cylinder is a circular column.

8. The screwdriver bit structure having auxiliary positioning function, as recited in claim 7, wherein said concave ring groove is positioned on a front end of said circular column which is proximal to said driving portion.

9. The screwdriver bit structure having auxiliary positioning function, as recited in claim 1, wherein said concave ring groove is positioned on the polygon shaft body at one end which is proximal to said driving portion.

* * * * *